US006073328A

United States Patent [19]

Hendricks

[11] Patent Number: 6,073,328

[45] Date of Patent: Jun. 13, 2000

[54] CARPET INSTALLATION TOOL

[76] Inventor: James Hendricks, 151½ N. Springfield St., Virden, Ill. 62690

[21] Appl. No.: 09/032,764

[22] Filed: Feb. 28, 1998

[51] Int. Cl.[7] ..... B25B 27/00

[52] U.S. Cl. ..... 29/270

[58] Field of Search ..... 294/49, 57, 8.6; 29/270, 275, 278, 254; 7/103

[56] References Cited

U.S. PATENT DOCUMENTS

| | | | |
|---|---|---|---|
| D. 339,966 | 10/1993 | Burnett | 294/57 |
| 2,710,571 | 6/1955 | Pfister | 294/57 |
| 3,546,726 | 12/1970 | Bizzigotti . | |
| 3,685,064 | 8/1972 | Cuscovitch, Sr. . | |
| 3,745,598 | 7/1973 | Krell . | |
| 4,750,226 | 6/1988 | Costill . | |
| 4,790,059 | 12/1988 | Killpack . | |
| 4,797,963 | 1/1989 | Gulino . | |
| 4,872,231 | 10/1989 | Gustavsen . | |
| 4,888,846 | 12/1989 | Natale | 294/57 |
| 5,203,852 | 4/1993 | Downing et al. . | |
| 5,771,535 | 6/1998 | Blessing | 294/57 |
| 5,802,960 | 9/1998 | Graj et al. | 294/57 |

OTHER PUBLICATIONS

Crain Cutter Co., Inc, "Crain Floor Covering Tools," Crain Floor Covering Tools, p. 18, 19, 27, (1995).

Beno J. Gundlach Company, "Gundlach," Beno J. Gundlach Company, No. 122, p. 17,24–25, 27, 39 (1993).

*Primary Examiner*—Robert C. Watson

*Attorney, Agent, or Firm*—Polster, Lieder, Woodruff & Lucchesi

[57] ABSTRACT

A carpet installation device is provided which enables a carpet installer to spread and tuck a carpet while the installer is in a substantially upright position. The device comprises a blade having a generally flat bottom edge, an elongate shaft extending upwardly from the blade, a hand grip on the shaft, and an arm bracket on the shaft above the hand grip. The shaft includes a lower portion, an upper portion horizontally offset from the lower portion, and a transition portion extending between the lower portion and the upper portion. The transition section is sized such that when the installer grasps the hand grip, his arm will be substantially aligned with the shaft bottom portion when his arm is generally in contact with the shaft upper portion. Preferably, the shaft top portion is offset from the shaft lower portion by approximately the width of a user's hand.

13 Claims, 3 Drawing Sheets

CARPET INSTALLATION TOOL

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to carpet installation devices, and, in particular, to a carpet spreader or tucker which may be used by a carpet layer in a substantially upright position.

The carpet laying process typically begins with applying a tacking strip around the perimeter of the room, spaced slightly from the wall. The tacking strip includes a narrow strip of wood, or other material, which has a plurality of spaced apart barbs. The tacking strip is installed so that the barbs are directed towards the wall. A carpet is rolled out in the room and cut roughly to size, with overlap at each wall. The carpet layer then stretches the carpet using a carpet stretcher to apply the bottom edge of the carpet to the tacking strip. Using a wedge or carpet spreader, the installer secures the carpet bottom to the tacking strip by pressing the carpet onto the tacking strip so that the barbs of the tacking strip will bite into the carpet backing. This is done prior to releasing the carpet stretcher. If the carpet is not anchored to the tacking strip using the carpet spreader, then the stretched portion of the carpet will not be held by the tacking strip. To ensure that the carpet is anchored to the tacking strip, the installer holds the carpet in place over the tacking strip with the spreader. He then releases the carpet stretcher and moves the carpet stretcher along the wall a short distance and again stretches the carpet. He then releases the spreader from the prior position to anchor the carpet at the new position of the stretcher. This process is repeated for the carpet around the entire periphery of the room. Once the carpet has been stretched and anchored to the tacking strip, the carpet is trimmed to remove the excess carpet. Lastly, the installer tucks the edge of the carpet into the space between the tacking strip and the wall or base board.

The tools currently used in a carpet installation require that the installer spend substantially the full time the carpet is being installed in a kneeling position. The carpet spreader commonly used is a blade having a flat bottom edge and a handle on the top to allow the installer to hold the blade. It is a short tool, approximately 4"–6" in overall height. Often, an installer will use a stair tool to perform the carpet tucking. This also is a relatively short tool which is used in conjunction with a hammer. The installer positions the tool and pounds on its handle with the hammer. Because both the carpet spreading and carpet tucking tools are small, the installer must kneel when installing a carpet. This kneeling position causes the installer's knees and waist to tire quickly. It also requires that the installer stand up or kneel to move the carpet stretcher after each iteration. Further, because the installer is kneeling, he can use only his arms and upper body to generate the force required to spread and tuck the carpet. This is an additional factor which causes the installer to tire quickly.

The kneeling position also makes the installation process very time consuming. The long time it takes to install a carpet in this conventional manner only serves to add to the fatigue of the installer. This fatigue can lead to problems in the installation. Primarily, the carpet will not be properly stretched, and will buckle at a later time. The owner will then have to hire an installer to restretch the carpet.

The wear and tear caused by the installation process also limits the number of years that one can work as an installer. Installers often develop knee problems from the wear and tear on their knees from the time spent kneeling.

The need to kneel during the installation process is due to the carpet spreader that is used. Typical carpet stretchers now in use can be used in a more erect and comfortable position. The carpet spreader or caulker, however, is typically a wide blade having a handle along an edge opposite the working edge of the blade. Because the carpet spreader is small, the carpet installer must use it in a kneeling position.

Further, conventional spreaders can be difficult to control accurately. During use, they can be inadvertently pivoted quickly, causing the carpet installer's knuckles to hit the wall. Additionally, the carpet installer may inadvertently mar woodwork, such as base boards, that are adjacent the floor. Similarly, the when using a hammer to tuck the carpet, the installer can inadvertently miss the handle of the carpet tucker, and hit the wall instead. The sudden force on the carpet tucker caused by hitting the tool with the hammer can also cause the carpet tucker to slip and hit the wall. This can also mar the wall. This can be especially detrimental if there is trim work at the level of the carpet.

BRIEF SUMMARY OF THE INVENTION

The following objects are present in one or more of the claims of the invention.

An object of the present invention is to provide a carpet installation device which will allow a carpet installer to stand substantially erect during a carpet installation process.

Another object is to provide such a device which can be used to both spread the carpet to anchor the carpet to the tacking strip during the stretching process and to tuck the carpet between the tacking strip and the wall after the carpet has been stretched and trimmed.

These and other objects will become apparent to those skilled in the art in light of the following disclosure and accompanying drawings.

The present invention overcomes the problems and allows for a carpet installer to spread and tuck a carpet in a substantially upright position. Briefly stated, a carpet installation device is provided which can be used by a carpet installer to anchor the carpeting to the tacking strip during stretching of the carpet, and to tuck the edge of the trimmed carpet between the tacking strip and the wall or base board after the carpet has been stretched. The device comprises a blade having a generally flat bottom edge, an elongate shaft extending upwardly from the blade, a hand grip on the shaft, and an arm bracket on the shaft above the hand grip. The shaft includes a lower portion, an upper portion horizontally offset from the lower portion, and a transition portion extending between the lower portion and the upper portion. The transition portion is sized such that when the installer grasps the hand grip, his arm will be substantially aligned with the shaft bottom portion when his arm is generally in contact with the shaft upper portion. Preferably, the shaft top portion is offset from the shaft lower portion by approximately the width of a user's hand (or approximately four inches). Thus, the upper portion of the shaft will be substantially adjacent the installer's forearm when the tool is grasped by the installer. The transition portion of the shaft is sloped, and preferably forms an angle of about 45° with the shaft upper and lower portions.

By allowing the carpet installer to work in a substantially upright position during the carpet stretching and spreading process, and during the carpet tucking process, the present invention overcomes the problems present in conventional carpet spreaders. The carpet installer does not kneel when using the device of the present invention. Thus, the wear and tear on his knees is reduced. Because he is in a substantially upright or standing position, the carpet installer can do his work more quickly and apply more force when spreading and tucking the carpet. Further, because the shaft of the device locks against the installer's arm during use, the installer has greater control over the device. This will reduce knuckle banging, and marring of wall trim.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
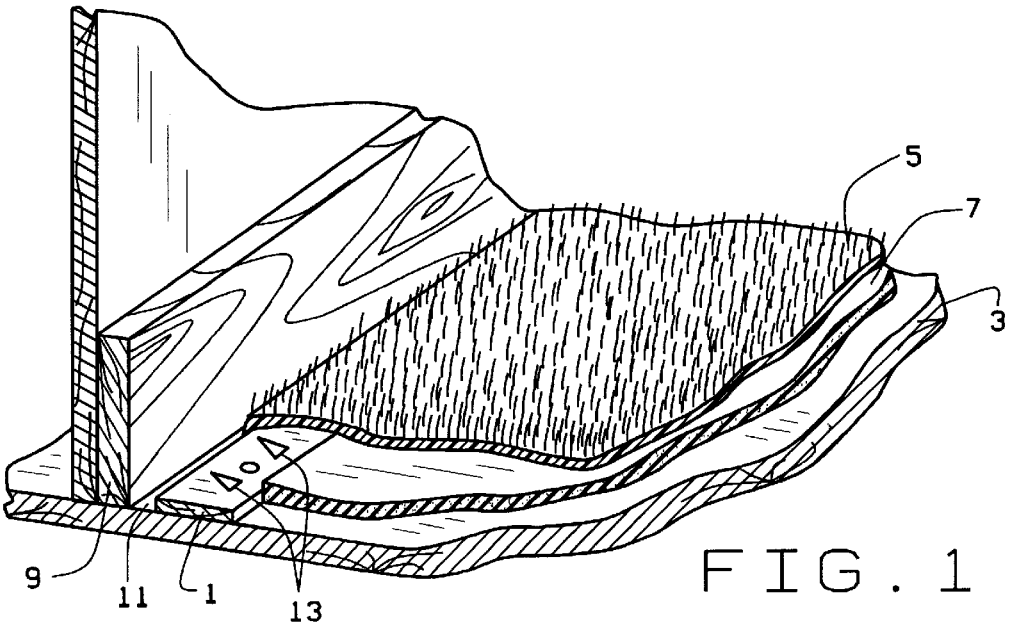
FIG. 1 is a perspective, cut-away view of a carpet installation.

A typical carpet installation is shown in FIG. 1. Generally, a tacking strip 1 is fixed to the floor 3 to hold a carpet 5 in place. Prior to placing the carpet across the floor, a carpet pad 7 is placed over a floor 3. The tacking strip 1 is nailed or otherwise fixed to the floor 3 spaced slightly from the wall or base board 9 of the room in which the carpet 5 is being installed. There is thus a gap 11 between the tacking strip 1 and the wall 9. The tacking strip 1 includes spaced apart barbs 13 which engage the back side of the carpet 5 to hold the carpet in place once it has been stretched, as discussed above.

Figure 2:
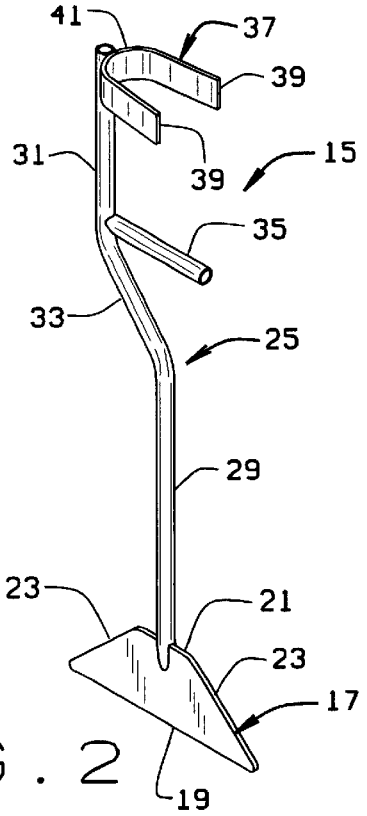
FIG. 2 is a perspective view of a carpet installation device of the present invention.

My carpet installation device or tool 15 is shown generally in FIG. 2. The tool 15, which can be used as a carpet spreader or a carpet tucker, includes a thin blade 17 having an elongate bottom edge 19. The blade also has a top edge 21 and side edges 23. The blade is shown to be generally trapezoidal in shape, but could be made in other shapes, if desired, as long as the bottom edge 19 is flat, so that it can be used to spread and tuck carpeting, as will be described below. The blade 17 is preferably made from a stainless steel plate, such as by stamping. However, it could be made from other materials as well.

A shaft 25 extends upwardly from the top edge 21 of the blade 17. Preferably, the shaft 25 is fixed to the blade's top edge 21 at the approximate center of the top edge 21. The blade 17 is shown to be permanently fixed, as by welding, to the shaft 25. The shaft 25, however, can be adapted to removably receive the blade 17, so that the blade 17 can be replaced when necessary. For example, the shaft 25 can have a slot at its lower end into which the blade fits, and a fastener can be provided to secure the blade 17 to the shaft 25.

The shaft 25 includes a lower portion 29 which extends upwardly from the blade 23 and a top portion 31. The shaft top portion 31 is horizontally offset from the shaft bottom portion 29. The shaft top and bottom portions 29 and 31 are substantially parallel to each other. A transitional or intermediate portion 33 extends between the shaft's top and bottom portions. The intermediate portion preferably is sloped, and forms an angle of about 45° with the top and bottom portions of the shaft. Thus, the bottom of the top portion 31 is also spaced above the top of the bottom portion 29.

A hand grip 35 extends from the top portion 31. The grip 35 is preferably perpendicular to the top portion 31 and extends out over the transitional portion 33 to be generally parallel to the blade edge 19. Thus, the shaft 25, the hand grip 35, and the blade all generally lie in the same plane. The hand grip 35 is preferably fixed to the shaft 25 near the bottom of the top portion 31. If desired, the hand grip 35 can be provided with a covering, such as a soft plastic or foam covering, to make it more comfortable to grasp and bear down upon.

The shaft 25 and the hand grip 35 are both preferably made from metal tubing. Tubing having a ¾" outer diameter has been found to be comfortable to grasp. The blade 17, hand grip 35 and arm bracket 37 are fixed to the shaft 25 by welding. However, they can be fixed to the shaft in any other conventional fashion.

Lastly, an arm bracket 37 is fixed to the shaft upper portion 31 above the hand grip 35. The bracket 37 is positioned on the shaft upper portion 31 such that when an installer grasps the hand grip 35, the bracket 37 will engage the installers forearm approximately midway between the installer's wrist and elbow. The arm bracket 37 is generally U-shaped, having two spaced apart legs 39 joined together by an arced web 41. The legs 39 are generally parallel to the hand grip 35. The arm bracket 37 is fixed to the shaft top portion 31 at the apex of the bracket so that the arm bracket 37 extends out over the hand grip 35. If desired, the arm bracket 37 can be provided with a lining, such as a cloth or foam lining, to make the bracket more comfortable during use.

Figure 4:
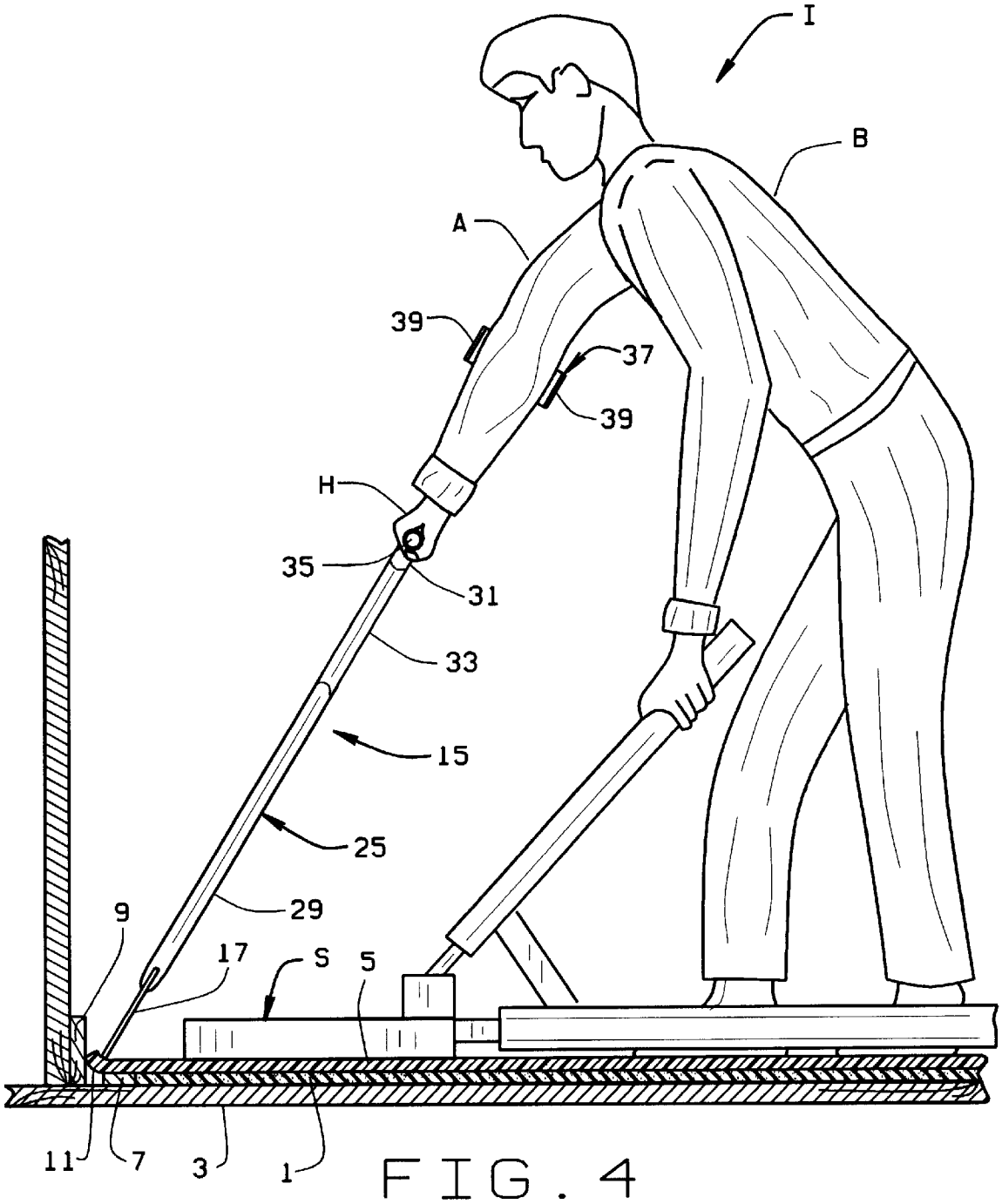
FIG. 4 is a view of an installer stretching a carpet in a substantially upright position when using the carpet installation device.
Figure 5:
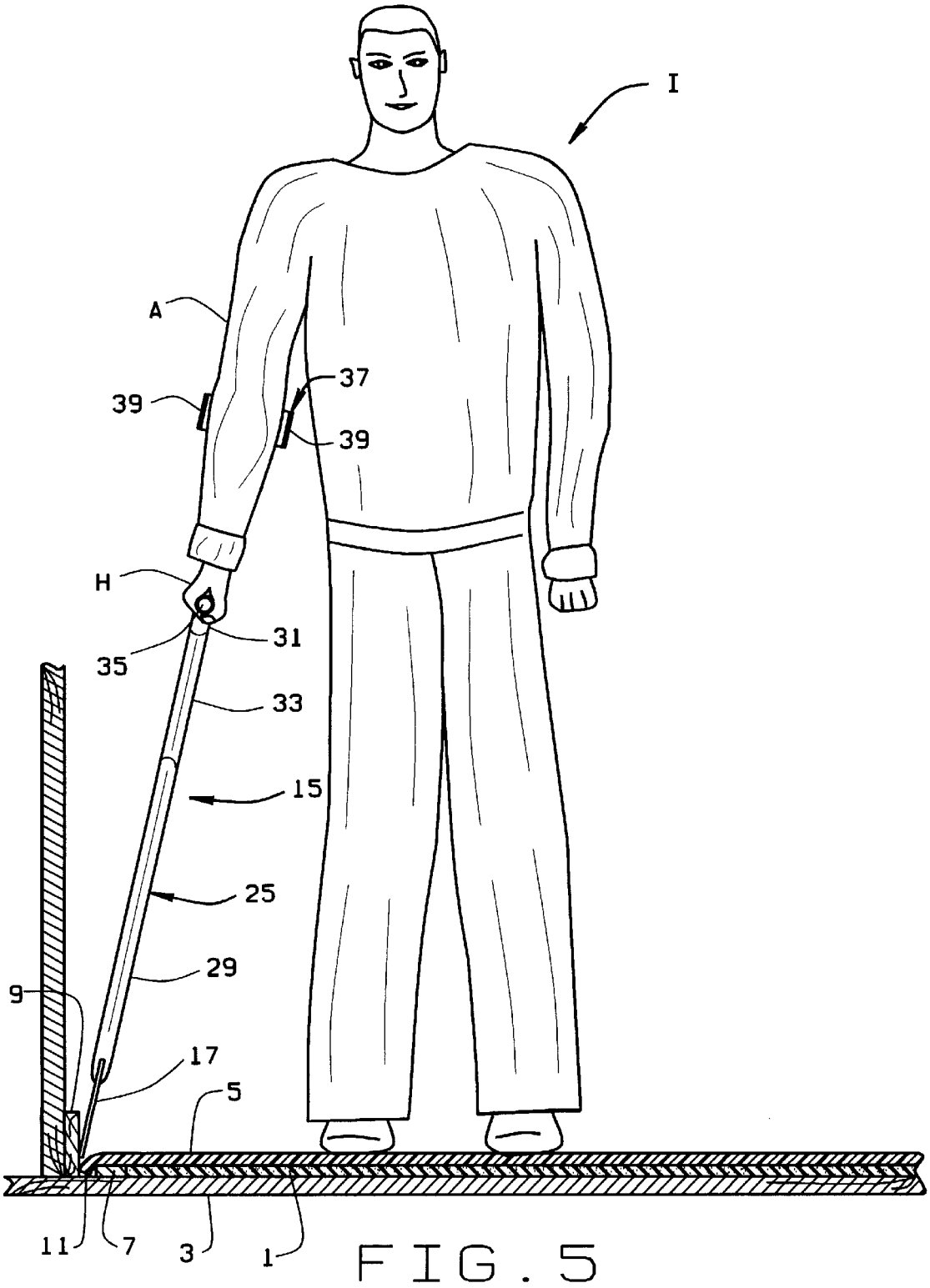
FIG. 5 is a perspective view of the installer, showing the installer in a substantially upright position when using the carpet installation device.

Use of the spreader/tucking tool 15 is shown in FIGS. 4 and 5. The tool 15 is held such that the arm bracket 37 wraps around the outside of the forearm A of the installer I with the top portion 31 of the shaft 25 extending along the outside of the installer's forearm A. The bracket 37 and the grip 35 thus extend generally toward the installer's body B, when the installer stands fully upright. The transitional section 33 of the shaft is sized such that when the installer grasps the tool 15, his forearm A is generally co-linear or generally aligned with the shaft bottom portion 29. Preferably, the distance D between the inner surface 43 of the shaft upper portion 31 and the outer surface 45 of the shaft bottom portion 29 is approximately equal to the width of the installer's hand H, or about 4". Thus, when the installer I pushes down on the carpet, as shown in FIG. 4 to anchor the carpet to the tacking strip, or in FIG. 5 to tuck the carpet into the gap 11, the force exerted by the installer is primarily in a vector that extends substantially along the shaft bottom portion 29. That provision of the upper shaft portion 31 enables the installer to better control the tool 15 so that the tool 15 will not have a tendency to pivot to one side or another of the blade 17.

The tool 15 has a length, from the bottom edge 19 of the blade 17 to the top of the shaft 25 of about 24" to 36", and preferably about 30". This length allows the installer to use the tool 15 in a substantially upright position, as seen in FIG. 4. The length of the tool 15 can be increased or decreased for use by taller or shorter people.

Figure 3:
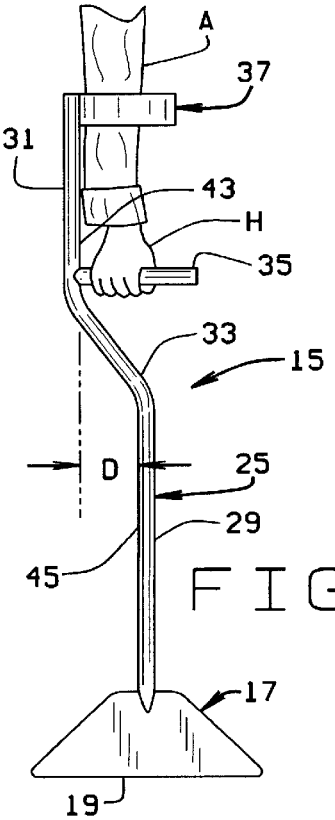
FIG. 3 is a perspective view showing the forearm of an installer while the installer is holding the carpet installation device.

When the installer I is stretching the carpet, the tool 15 allows the installer to spread the carpet over the tacking strip 1 to anchor the carpet 5 to the tacking strip 1 in a substantially upright position. Thus, the installer does not have to kneel, as he does when using a traditional carpet spreader. Further, when the installer presses down on the tool 15, the offset of the shaft upper section 31 from the shaft lower section 29 causes the shaft upper section to lock against the installer's forearm, as shown in FIG. 3. This gives the installer better and greater control over the blade 17 than he has with a conventional carpet spreader or carpet tucker. The blade is thus less likely to slip when being used, reducing the possibility of damage to the wall or base board during installation of the carpet. The ability for the installer to be substantially upright also makes it easier for the installer to hold the carpet in place over the tacking strip to hook or anchor the carpet to the tacking strip so that the installer can move the carpet stretcher S to a new position to continue the stretching of the carpet. Those skilled in the art will recognize that the stretcher S is a power stretcher.

The fact that the installer is substantially upright, rather than kneeling, enables the installer to use power stretchers, rather than kick stretchers, which reduces the wear on the installer's knees. Further, because the installer does not have to get up from a kneeling position each time he has to move the stretcher, the carpet can be stretched about a room more quickly and with less fatigue. Once the carpet is stretched and trimmed, the installer can tuck the edge of the carpet into the gap 11 between the tacking strip 1 and the wall or base board 9 simply by walking about the perimeter of the room and pressing down on the tool 15. Because the installer is not kneeling when tucking the carpet, this step of carpet installation is performed much more quickly than with a standard carpet tucker. Further, because the installer I is substantially upright, he can use his whole body when pressing down on the carpet to spread or tuck the carpet. With a conventional carpet spreader/tucker, the installer kneels, and thus only had his upper body to push down on the conventional tool. When the installer is in the upright position, he can generate more force, and thus, he can do a better job of spreading the carpet 5 over the tacking strip 1. Further, because the installer is substantially upright, rather than kneeling, the installer will not tire as quickly. All these advantages of my carpet stretcher/tucker 15 enables the installer to perform a better carpet installation. Further, the construction of the tool 15 allows for the tool to be used equally well by left-handed and right-handed people.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. For example, although the shaft, hand grip, and bracket are made from metal, they can be made from other materials, for example, a plastic. Use of a plastic would allow the shaft, hand grip, and arm bracket to be molded as a one-piece part to which the blade is fixed. This example is merely illustrative.

What is claimed is:

1. A carpet installation tool for use in spreading a carpet over a tacking strip and for tucking an edge of the carpet in a space between the tacking strip and a wall adjacent the tacking strip; the installation tool comprising a blade having a generally flat bottom edge, a shaft extending upwardly from said blade and having an upper portion and a lower portion, the shaft upper portion being offset from the shaft lower portion, a hand grip on said shaft upper portion, the hand grip extending over said shaft lower portion, and a bracket above said hand grip which extends over said hand grip; the device having an overall length such that a carpet installer can stand substantially upright when using the tool, whereby, when a carpet installer presses down on said hand grip, a portion of said bracket will bear against an arm of the installer to enable controlled, one-hand operation of the carpet installation tool.

2. The carpet installation tool of claim 1 wherein the shaft is configured such that when it is gripped by the installer, the installer's arm and the shaft extending up from the blade are generally aligned.

3. The carpet installation tool of claim 2 wherein the shaft includes a transition portion extending between said lower portion and said upper portion.

4. The carpet installation tool of claim 3 wherein said hand grip is near the bottom of said shaft upper portion.

5. The carpet installation tool of claim 3 wherein said arm bracket is mounted to said shaft upper portion to engage the installers arm approximately midway between a wrist and elbow of the installer's arm when the installer grasps the hand grip.

6. The carpet installation tool of claim 3 wherein said shaft top portion is offset from said shaft lower portion by approximately the width of a user's hand.

7. The carpet installation tool of claim 6 wherein said shaft top portion is offset from said shaft lower portion by approximately four inches.

8. The carpet installation tool of claim 3 wherein the transitional portion of the shaft is sloped.

9. The carpet installation tool of claim 8 wherein the transitional portion of the shaft defines an angle of about 45° with the shaft upper and lower portions.

10. A carpet installation tool comprising:

a blade having a generally flat bottom edge and a top edge, said blade defining a plane;

a shaft extending upwardly from the approximate center of said blade, the shaft having a length sufficient to enable a carpet installer to use the tool in a substantially upright position; the shaft including a lower portion, an upper portion horizontally offset from said lower portion, and a sloped transition portion extending between said lower portion and said upper portion, said upper and lower portions being generally parallel with each other, a bottom of the shaft top portion being spaced in two axes from a top of said shaft bottom portion;

a hand grip on said shaft extending from said shaft over said transition portion and being in the blade plane, whereby, when a carpet installer uses said tool and presses down on said handle, substantially all forces generated by the installer extend primarily in a vector which extends substantially along the shaft lower portion; and an arm bracket on said shaft; said arm bracket being above said hand grip a distance sufficient to be at least approximately midway between the installer's wrist and elbow; said bracket having a mounting portion and portions extending from said mounting portion in a plane extending over said hand grip; said bracket being fixed to said shaft at said bracket mounting portion; whereby when the installer presses down on the hand grip, the bracket mounting portion will bear against the installer's arm at least approximately midway between the installer's wrist and elbow to enable one handed operation of the tool.

11. The carpet installation tool of claim 10 wherein said shaft top portion is offset from said shaft lower portion by approximately the width of a user's hand.

12. The carpet installation tool of claim 11 wherein the transitional portion of the shaft defines an angle of about 45° with the shaft upper and lower portions.

13. The carpet installation tool of claim 10 wherein the tool shaft includes only a single translation portion and only a single upper portion.

* * * * *